US006857236B2

(12) United States Patent
Mangeard

(10) Patent No.: US 6,857,236 B2
(45) Date of Patent: Feb. 22, 2005

(54) SLATTED ROOFING DEVICE WITH VENTILATION

(76) Inventor: Philippe Mangeard, La Maison Rose, 164 Avenue de la Clua, Nice F-06100 (FR)

( * ) Notice: Subject to any disclaimer, the term of this patent is extended or adjusted under 35 U.S.C. 154(b) by 0 days.

(21) Appl. No.: 10/332,571

(22) PCT Filed: Jul. 18, 2001

(86) PCT No.: PCT/FR01/02327

§ 371 (c)(1),
(2), (4) Date: Jan. 10, 2003

(87) PCT Pub. No.: WO02/12648

PCT Pub. Date: Feb. 14, 2002

(65) Prior Publication Data

US 2003/0140586 A1 Jul. 31, 2003

(30) Foreign Application Priority Data

Aug. 7, 2000 (FR) ..... 00 10415

(51) Int. Cl.[7] ..... E06B 1/70

(52) U.S. Cl. ..... 52/302.1; 52/66; 52/64; 49/38; 49/128; 454/199

(58) Field of Search ..... 52/66, 64, 302.11; 49/38, 128, 130, 125; 454/199, 220, 221

(56) References Cited

U.S. PATENT DOCUMENTS

| | | | | | |
|---|---|---|---|---|---|
| 1,411,866 | A | * | 4/1922 | Morris | 49/38 |
| 1,531,398 | A | * | 3/1925 | Hough | 49/38 |
| 2,642,634 | A | | 6/1953 | Recob | |
| 6,148,571 | A | * | 11/2000 | Seyller | 52/200 |
| 6,481,167 | B2 | * | 11/2002 | Liddell | 52/202 |

FOREIGN PATENT DOCUMENTS

| | | |
|---|---|---|
| DE | 29 50 564 | 8/1980 |
| FR | 2 723 612 | 2/1996 |
| FR | 2 747 707 | 10/1997 |

* cited by examiner

*Primary Examiner*—Kimberly Wood
(74) *Attorney, Agent, or Firm*—Young & Thompson

(57) ABSTRACT

A slatted roofing device, includes a frame (1) receiving a lower series (2) of grid-type mounted slats and at least a support (3) superimposed on the frame (1) receiving an upper series (4) of grid-type mounted slats, the support (3) being transversely mobile with respect to the longitudinal direction of the slats on the frame (1) to modify the lateral position of the slats of the upper series (4) relative to those of the lower series (2), the slats shifting from a completely overlapping position when the roof is open to a partial overlapping position when the roof is closed. The device includes an apparatus for lifting the support (3) relative to the frame (1) to allow air to pass through the roof even when the series of upper (4) and lower slats cover the whole roof surface.

7 Claims, 2 Drawing Sheets

SLATTED ROOFING DEVICE WITH VENTILATION

The present invention relates to a roofing device with slats comprising a chassis receiving a lower series of slats mounted spaced apart and at least one support superposed from the chassis receiving an upper series of slats mounted spaced apart, the support being movable transversely to the direction of the length of the slats on the chassis to modify the lateral position of the slats of the upper series relative to those of the lower series, the slats passing from one position of total overlap when the roofing is open to a partially overlapping position when the roofing is closed.

This device will find particular application in the field of covering balconies or terraces or else to constitute a roofing element for verandas or other types of buildings.

There is known at present a roofing device permitting the modulation and distribution of sunshine, from the document FR-A-2747707.

According to this document, a device is proposed to obtain a slatted roofing device with ventilation.

Such a device is satisfactory as to the distribution of the regions of shadow and light. However, when total darkness is desired, the roofing is totally closed. It is understood by this that no passage of air is permitted between the slats to ventilate the roofing.

Such roofing has limited possibilities of use: the user cannot totally shield himself from the sun or rain whilst maintaining ventilation through the roofing.

The invention has for its object to overcome this drawback and to propose for this purpose a roofing device in which the slats have the capability of movement increase relative to known techniques.

In particular, beyond the transverse movement, the slats can be movable so as to ensure offsetting as to level and to permit passage of air through an interstitial space.

Other objects and advantages will become apparent from the description which follows.

The present invention relates to a slatted roofing device, comprising a chassis receiving a lower series of slats mounted spaced apart and at least one support superposed on the chassis receiving an upper series of slats mounted spaced apart, the support being movable transversely to the lengthwise direction of the slats on the chassis to modify the lateral position of the slats of the upper series relative to those of the lower series, the slats passing from a totally overlapping position when the roof is open, to a partially overlapping position when the roof is closed, characterized by the fact that it comprises means for elevating the support relative to the chassis to permit the passage of air through the roof even when the upper and lower series of slats totally overlap all the surface of the roof.

This device can have the modifications set forth hereafter:

- the elevation means comprise several carriages distributed along the transverse edges of the support, each carriage comprising at least one wheel adapted to move transversely on a rolling surface secured to the chassis, said rolling surface comprising:
- two flat parallel regions at different elevations;
- a connecting ramp between the two flat regions, the amplitude of transverse movement of the support to the foot of the ramp being less than or equal to the width of overlap of two superposed slats, one of the lower series, the other of the upper series, when the roofing is in the closed position.
- the support comprises two transverse longitudinal beams on each of which are mounted a portion of the carriages.

- the rolling surface is constituted, for each carriage, by a profile having a flat wing mounted on the chassis and to which is connected a wedge provided with an oblique portion forming the ramp and a flat portion parallel to the flat wing to form the flat regions.
- at least one series of slats is of triangular cross-section whose base constitutes the width of the slat.
- the base of the slats is prolongated, beyond the other isometric sides of the slats, by a wing coacting with sealing means.
- the lower series of slats is of triangular cross-section whose base constitutes the width of the slat and said base is incurved inwardly of the roofing to create a channel for the evacuation of water.

The accompanying drawings are given by way of indicative example and are not limiting. They show one embodiment according to the invention, they permit easy comprehension of the invention.

FIG. 1 shows generally an embodiment of the roofing device in question.

Figure 1:
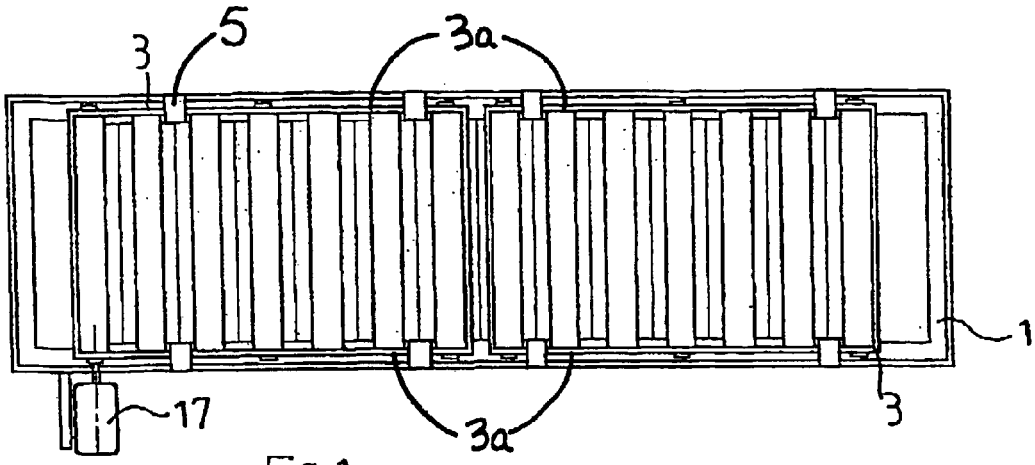
FIG. 1 is a general view from above of a roofing device in a particular embodiment.
Figure 2:
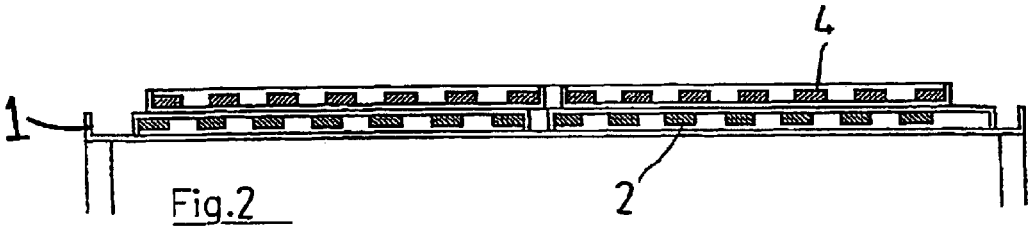
FIG. 2 is a longitudinal view in cross-section of such a device.

This device comprises a chassis 1 on which are mounted various slats constituting a series of lower slats 2 shown in FIG. 2. The chassis 1 is movably mounted in a transverse direction corresponding to the perpendicular to the longitudinal direction of the slats, at least one support 3 adapted to receive a plurality of slats constituting an upper series 4 also visible in FIG. 2.

Drive means, which can be manual or constituted by a one of the supports 3, ensure the transverse mobility of the support 3 relative to the chassis 1.

Guiding movement means ensure the movement of the support 3 relative to the chassis 1.

In particular, a support structure as shown in the mentioned document FR-A 2747707 is suitable and can be used in the present invention.

Because of the mobility of the series of upper slats 4, it is possible to vary stepwise or continuously the condition of overlap of the series of lower slats 2 and upper slats 4. The regions of shadow and light are thus modified as desired according to the wishes of the user.

In addition to this possibility, the present invention has the advantage of permitting the roof to be ventilated whilst maintaining complete protection from the sun and rain.

To this end, the device comprises means for elevating the support 3 relative to the chassis 1. To do this, the series of upper slats 4 is raised relative to the series of lower slats 2, which permits the creation of an interstitial space between their two respective levels.

According to a preferred embodiment, the elevation means comprise several carriages 5, for example four, distributed along the transverse edges of the support 3 so as to drive the latter with an elevational movement relative to the chassis 1.

To do this, the carriages 5 comprise at least one wheel 6 adapted to move transversely over a rolling surface secured to the chassis 1.

To effect elevation, the rolling surface comprises two flat parallel regions indicated respectively at 7*a* for the lower level region and 7*b* for the upper level region. Between these two zones 7*a*, 7*b*, a portion of the rolling surface is constituted by a connecting ramp 8.

Figure 3:
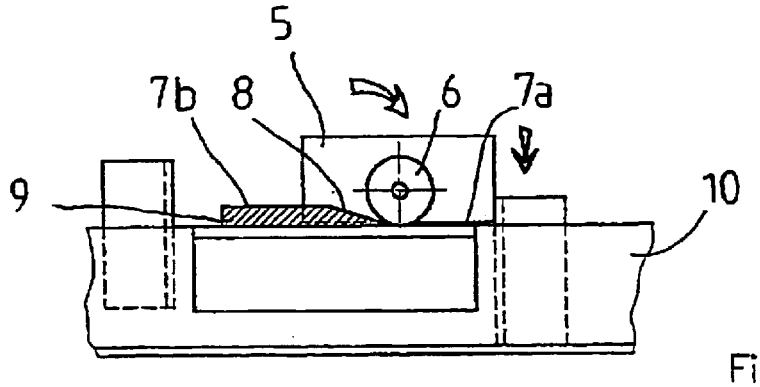
FIGS. 3 and 4 show a particular embodiment of the elevation means.
Figure 4:
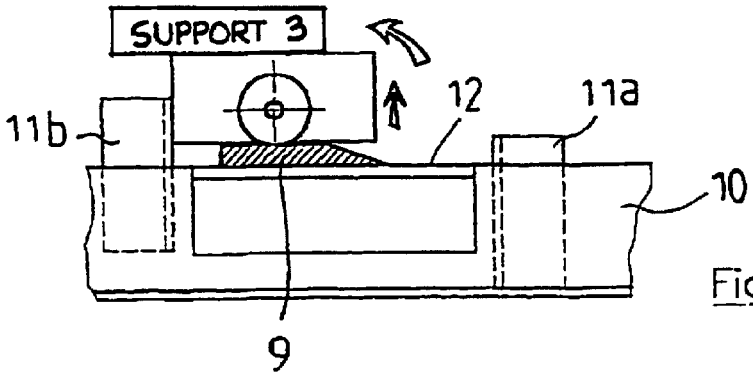

As can be seen in FIGS. 3 and 4, the wheel 6 of the carriage 5 is adapted to traverse the rolling surface from the lower flat region 7*a* to the upper flat region 7*b* and this via a transition region constituted by the ramp 8.

It is easy to see that this deign combines the traverse movement of the support 3 with that of elevation.

To permit passage of air through the roofing whilst preserving complete protection from the sun and rain, it is important to adjust the degree of movement of the support 3 according to the size of the blades and their overlap.

More precisely, the amplitude of transverse movement of the support 3 to the foot of the ramp 3 will be less than or equal to the width of overlap of the two superposed slats.

Figure 6:
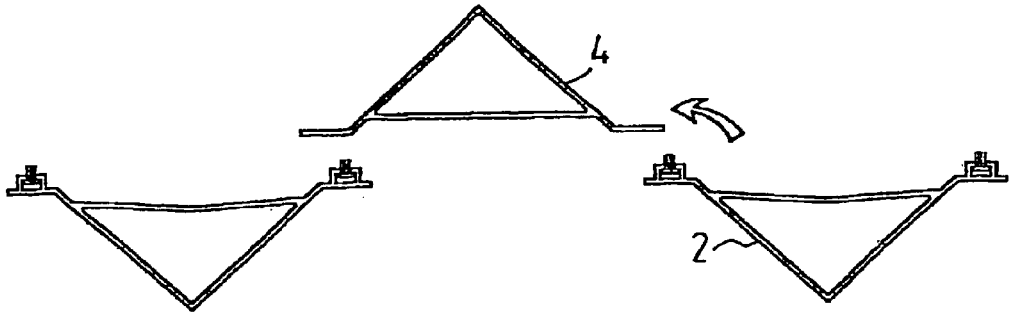

By this particular choice of size and amplitude of movement, there can be obtained a relative position of the slats of the lower series 2 and upper series 4 as shown in FIG. 6.

It will be seen that no region of the roofing is exposed to the outside and at the same time ventilation is permitted.

Preferably, the overall support 3 comprises two longitudinal beams 3*a* on opposite sides of the ends of the slats, the beams extending transversely and each receiving half the carriages 5.

As shown in FIGS. 3 and 4, the rolling surface for the wheel 6 can comprise a wedge 9 adapted to constitute the flat region of upper level 7*b* and the ramp 8.

This wedge 9 is positioned on a track 12 of the profile 10 mounted on the chassis 1. In this way, the rolling surface is provided very effectively and at least cost.

Moreover, it is advantageous to provide abutments 11*a*, 11*b* to limit the amplitude of movement of the carriage 5. To this end, an abutment 11*a* as shown in FIG. 4 permits limiting the movement of the carriage when the support is in the lower position and an abutment 11*b* permits limiting the movement of the carriage when the support 3 is in elevated position.

Figure 5:
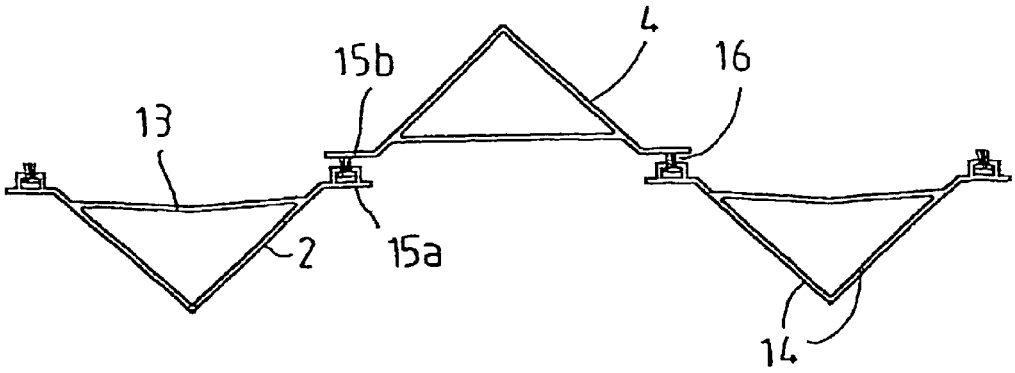
FIGS. 5 to 7 show schematically different configurations of opening or closing of the present device.
Figure 7:
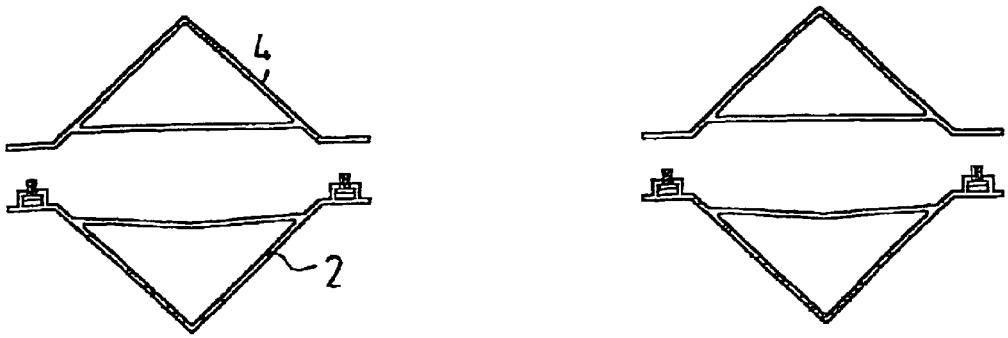

FIGS. 5 to 7 show different relative positions of the series of lower slats 2 and upper slats 4.

FIG. 5 shows partially the roofing device in a totally closed position. FIG. 6 shows an intermediate position in which ventilation is permitted whilst protection from the sun and weather is preserved. FIG. 7 shows a position of substantial overlap between the slats of the upper series 4 and lower series 2 permitting a wide opening of the roofing device according to the invention, to the outside.

As shown in FIGS. 5 to 7, one of the series of slats and preferably both series 2, 4 have slats of triangular cross-section.

In particular, an isosceles triangular cross-section is preferred with a base 13 constituting the width of the slat and isometric sides 14 constituting the two other sides.

It is preferable that the slats carry sealing means 16. The latter can be constituted by a joint mounted in a recess formed on one of the blades and is applied by its other edge on a slat of the opposite series.

To carry the sealing means 16, the base 13 of the slats comprises wings 15*a*, 15*b*.

Moreover, the base 13 of the slats of the lower series 2 will preferably be incurved toward the interior of the roofing so as to create a channel for evacuation of water.

The roofing device thus constituted is usable in a very practical manner.

It suffices that the user actuate manually or by motorization (for example an electric motor reducer or a hydraulic system) the transverse movement of the support 3 relative to the chassis 1.

According to the preferred embodiment of the invention, the transverse movement thus produced gives rise to a movement of elevation by the particular design of the rolling surface on which the wheels 6 of the carriages 5 are positioned.

According to the degree of advance of the transverse movement of the support 3 on the chassis 1, the overlapping surface of the slats can be modified as desired as well as the relative position of the series of upper slats 4 relative to the series of lower slats 2.

REFERENCES

1. chassis
2. lower series of slats
3. support
4. upper series of slats
5. carriage
6. wheel
7*a*, 7*b*. flat regions
8. ramp
9. wedge
10. profile
11*a*, 11*b*. abutment
12. track
13. base
14. isometric sides
15*a*, 15*b*. wing
16. sealing means
17. motorization

What is claimed is:

1. Slatted roofing device, comprising:

a chassis (1) receiving a lower series of slats (2) mounted spaced apart;

at least one support (3) superposed on the chassis (1) receiving an upper series (4) of slats mounted spaced apart, the support (3) being movable transversely to a longitudinal direction of the lower series of slats on the chassis (1) to modify a lateral position of the slats of the upper series (4) relative to the slats of the lower series (2), the upper and lower series of slats passing from a position of total overlap with one another when the roofing device is open to a position of partial overlap when the roofing device is closed;

means for elevating the support (3) relative to the chassis (1) to permit passage of air through the roofing device even when the series of upper slats (4) and the series of lower slats overlap all the surface of the roofing, the means for elevating comprising carriages (5) distributed along transverse edges of the support (3), each carriage (5) comprising at least one wheel (6) adapted to move transversely over a rolling surface secured to the chassis (1), said rolling surface comprising:

two flat parallel regions (7*a*, 7*b*) at different levels of elevation; and a ramp (8) connecting between the two flat regions (7*a*, 7*b*), such that an amplitude of transverse movement of the support up to a foot of the ramp (8) is less than or equal to a width of overlap of one the slats of the lower series (2), with respect to one of the slats of the upper series (4), when the roofing device is in the closed position.

2. Slatted roofing device according to claim 1, wherein the support (3) comprises two transverse longitudinal beams on each of which are mounted a portion of the carriages (5).

3. Slatted roofing device according to claim 1, wherein the rolling surface comprises, for each carriage (5), a profile having a flat track (12) mounted on the chassis (1) and to which is connected a wedge (9) provided with an oblique portion forming the ramp (8) and with a flat portion parallel to the flat track (12) to form the flat regions.

4. Slatted roofing device according to claim 1, wherein at least one of the upper and lower series of slats (2, 4) is of triangular cross-section whose base (13) constitutes a width of the slat.

5. Slatted roofing device according to claim 4, wherein the base (13) of the triangular cross-section slats is prolonged beyond other sides (14) of the triangular cross-section slats by a wing **(15*a*, 15*b*) having with sealing means (16)**.

6. Slatted roofing device according to claim 4, wherein the lower series of slats (2) is of triangular cross-section whose base (13) constitutes the width of the slat, said base (13) being incurved toward an interior of the roofing device to create a channel for evacuation of water.

7. Slatted roofing device according to claim 2, wherein the rolling surface comprises, for each carriage (5), a profile having a flat track (12) mounted on the chassis (1) and to which is connected a wedge (9) provided with an oblique portion forming the ramp (8) and with a flat portion parallel to the flat track (12) to form the flat regions.

* * * * *